US011806838B2

(12) United States Patent
Zu et al.

(10) Patent No.: US 11,806,838 B2
(45) Date of Patent: Nov. 7, 2023

(54) FLOOR PAD WITH VARIABLE ABRASIVE DISTRIBUTION

(71) Applicant: 3M INNOVATIVE PROPERTIES COMPANY, St. Paul, MN (US)

(72) Inventors: Lijun Zu, Woodbury, MN (US); Andrew C. Anderson, Hudson, WI (US); Sarah L. Hagen, Inver Grove Heights, MN (US); Jesse D. Lund, Saint Paul, MN (US); Qihong Nie, Woodbury, MN (US); David C. Raithel, Hudson, WI (US); Kim C. Sachs, Jr., Woodbury, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 727 days.

(21) Appl. No.: 16/635,332

(22) PCT Filed: Jul. 9, 2018

(86) PCT No.: PCT/IB2018/055037
§ 371 (c)(1),
(2) Date: Jan. 30, 2020

(87) PCT Pub. No.: WO2019/025883
PCT Pub. Date: Feb. 7, 2019

(65) Prior Publication Data

US 2020/0156216 A1 May 21, 2020

Related U.S. Application Data

(60) Provisional application No. 62/539,120, filed on Jul. 31, 2017.

(51) Int. Cl.

| | |
|---|---|
| ***B24D 11/04*** | (2006.01) |
| ***B24D 11/06*** | (2006.01) |
| *B24D 3/28* | (2006.01) |

(52) U.S. Cl.
CPC ..... *B24D 11/04* (2013.01); *B24D 11/06* (2013.01); *B24D 3/28* (2013.01)

(58) Field of Classification Search
CPC ..... B24D 3/00; B24D 11/00; B24D 18/00; B24D 11/04; B24D 11/06; B24D 3/28; C09K 3/14
(Continued)

(56) References Cited

U.S. PATENT DOCUMENTS

| | | | |
|---|---|---|---|
| 2,958,593 | A | 11/1960 | Hoover |
| 6,062,958 | A | 5/2000 | Wright |

(Continued)

FOREIGN PATENT DOCUMENTS

| | | |
|---|---|---|
| EP | 1595645 | 11/2005 |
| EP | 1702714 | 9/2006 |

(Continued)

OTHER PUBLICATIONS

US 8,152,599 B2, 04/2012, Thysell (withdrawn)

(Continued)

*Primary Examiner* — James E McDonough

(57) ABSTRACT

A surface-treating article, comprising a circular substrate (100) comprising a first major surface, an abrasive disposed on the first major surface, the abrasive having a first concentration at a first radius (110) measured from the center of the substrate, the abrasive having a second concentration not equal to the first concentration at a second radius (120) measured from the center of the substrate, wherein the first radius (110) and the second radius (120) are different lengths.

15 Claims, 8 Drawing Sheets

(58) Field of Classification Search
USPC ..... 51/293, 298
See application file for complete search history.

(56) References Cited

U.S. PATENT DOCUMENTS

| | | | | |
|---|---|---|---|---|
| 7,993,419 | B2 | 8/2011 | Hall | |
| D843,672 | S | 3/2019 | Hagen | |
| D843,673 | S | 3/2019 | Raithel | |
| D844,272 | S | 3/2019 | Anderson | |
| 2005/0095959 | A1 | 5/2005 | Sung | |
| 2006/0211340 | A1* | 9/2006 | Thysell ..... | B24D 13/142 451/41 |
| 2010/0266812 | A1 | 10/2010 | Lugg | |
| 2012/0162557 | A1 | 6/2012 | Nakazawa | |
| 2013/0324021 | A1 | 12/2013 | Ryan | |
| 2014/0154961 | A1 | 6/2014 | Fiore | |
| 2015/0004889 | A1 | 1/2015 | Seth | |
| 2018/0264626 | A1 | 9/2018 | Sventek | |

FOREIGN PATENT DOCUMENTS

| | | |
|---|---|---|
| JP | 2008532781 | 8/2008 |
| WO | WO 2012-157006 | 11/2012 |

OTHER PUBLICATIONS

"Cyclone-D™ Diamond Pads", ACS Industries [retrieved from the internet on Sep. 1, 2017], URL <http://acs-cp.com/products/floor-maintenance-pads/cyclone-d-diamond-pads/>, 2017, p. 1.

International Search Report for PCT International Application No. PCT/IB2018/055037, dated Oct. 26, 2018, 7 pages.

* cited by examiner

FLOOR PAD WITH VARIABLE ABRASIVE DISTRIBUTION

CROSS REFERENCE TO RELATED APPLICATIONS

This application is a national stage filing under 35 U.S.C. 371 of PCT/IB2018/055037, filed Jul. 9, 2018, which claims the benefit of Provisional Application No. 62/539,120, filed Jul. 31, 2017, the disclosure of which is incorporated by reference in their entirety herein.

BACKGROUND

Non-woven floor pads have been commercially available for many years. The floor pads have a wide variety of types to provide many functions. Some pads are extremely abrasive and are desirably used for wax stripping and cleaning floor surfaces which are heavily encrusted with soil. Other floor pads are mildly abrasive and sometimes used for daily maintenance and floor polishing. The different abrasive properties of the pads are achieved by appropriate selection of the fibers, resin binders and abrasive materials used in their construction. Stripping and cleaning pads are used on a rotary machine at low rotational speed of 50 rpm to 250 rpm. Burnishing pads are normally used on a rotary machine at high rotational speed of 1500 rpm to 3000 rpm.

Among all types of floor pads, uniform distribution of abrasives across the entire surface and/or through the thickness of non-woven web is traditionally desired. One exception is the ACS Cyclone® CYCLONE-D™ diamond pad. Diamonds are only present on an outer circle of this pad. This is done primarily for economic reasons to reduce the use of expensive diamonds by leaving the center uncovered by diamonds. Due to the pad holder in the center of the diamond pad, the about 4" circle in the center of the pad is not actually contacting the floor when the pad is mounted to a cleaning machine.

However, for both uniform abrasives coverage on a floor pad and the outer circle coverage on the surface as described with respect to the ACS Cyclone® CYCLONE-D™ diamond pad, the scratch pattern on the floor generated by abrasives on the floor pad is not uniform, due to velocity difference from center to edge of the pad and translational movement of the floor scrubbing machine. These types of floor pads give a non-uniform appearance on the floor when the floor pad is moving in one direction with self-rotation around a central axis.

It is therefore desirable to develop a new floor pad that allows for superior control of the uniformity of appearance due to abrasion of a floor or other surface.

SUMMARY OF THE INVENTION

In some embodiments of the present invention, a surface-treating article is provided. The surface-treating article includes a circular substrate with a first major surface and an abrasive disposed on the first major surface. The abrasive has a first concentration at a first radius measured from the center of the substrate, and the abrasive having a second concentration not equal to the first concentration at a second radius measured from the center of the substrate, where the first radius and the second radius have different lengths.

In some embodiments, the surface-treating article includes a circular substrate including natural fiber, a polyamide, a polyester, rayon, polyethylene, polypropylene, or a combination thereof, having a first major surface and a single abrasive formulation disposed on the first major surface. The single abrasive formulation has a first concentration at a first radius, and the single abrasive formulation has a second concentration at a second radius that is a different length than the first radius, where the ratio of the first concentration to the second concentration ranges from about 2:1 to about 1.1:1.

In some embodiments, the surface-treating article includes a circular substrate including natural fiber, a polyamide, a polyester, rayon, polyethylene, polypropylene, or a combination thereof, having a first major surface and a single abrasive formulation disposed on the first major surface. The single abrasive formulation has a first concentration at a first radius, and a single abrasive formulation has a second concentration at a second radius that is a different length than the first radius, where the ratio of the first concentration to the second concentration ranges from about 1:1.2 to about 1:2.2.

In some embodiments, a surface-treating article for controlling the amount of material removed from a work-surface is provided. The surface-treating article includes a circular substrate having a first major surface and an abrasive disposed on the first major surface. The abrasive has a first concentration at a first radius measured from the center of the substrate, and the abrasive having a second concentration not equal to the first concentration at a second radius measured from the center of the substrate that is a different length than the first radius, where the amount of material removed from a work-surface by the surface-treating article is a function of the difference between the first concentration and the second concentration.

Advantageously, the surface-treating articles described herein are able to achieve more uniform finishes when used on a work-surface due to the radially non-uniform abrasive grain distribution on the surface-treating articles. In some embodiments, by including multiple abrasive regions, each of which with a gradient distribution of abrasive particles, fine control of the finish on a work surface can be achieved. Advantageously, by placing more abrasives in a more effective working region, a higher removal rate from a work surface can be achieved.

BRIEF DESCRIPTION OF THE FIGURES

In the drawings, which are not necessarily drawn to scale, like numerals describe substantially similar components throughout the several views. Like numerals having different letter suffixes represent different instances of substantially similar components.

The drawings illustrate generally, by way of example, but not by way of limitation, in accordance various embodiments of the present invention.

DETAILED DESCRIPTION OF THE INVENTION

Figure 1A:
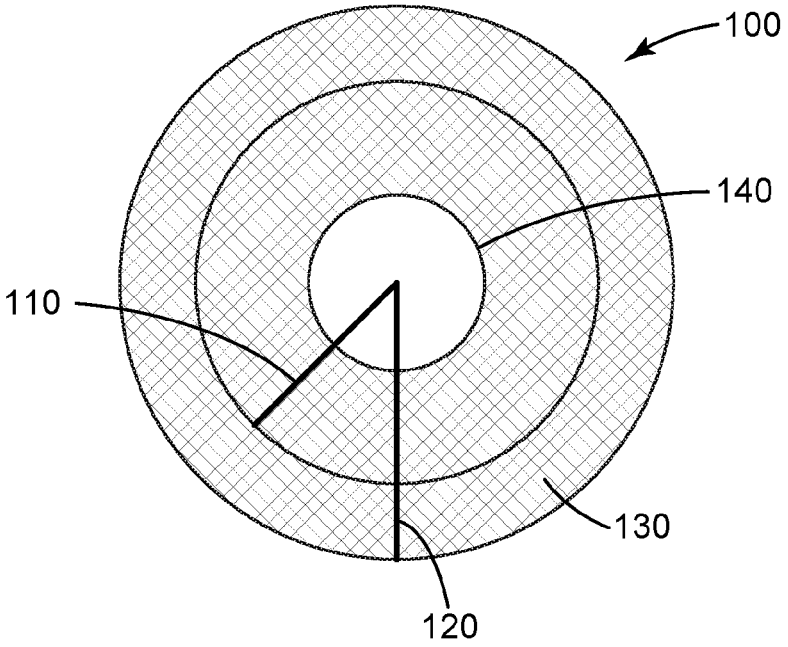
FIG. 1*a* is a schematic of the surface-treating article showing a region with a first and second abrasive concentration, in accordance with various embodiments.

Reference will now be made in detail to certain embodiments of the disclosed subject matter, examples of which are illustrated in part in the accompanying drawings. While the disclosed subject matter will be described in conjunction with the enumerated claims, it will be understood that the exemplified subject matter is not intended to limit the claims to the disclosed subject matter.

Throughout this document, values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "about 0.1% to about 5%" or "about 0.1% to 5%" should be interpreted to include not just about 0.1% to about 5%, but also the individual values (e.g., 1%, 2%, 3%, and 4%) and the sub-ranges (e.g., 0.1% to 0.5%, 1.1% to 2.2%, 3.3% to 4.4%) within the indicated range. The statement "about X to Y" has the same meaning as "about X to about Y," unless indicated otherwise. Likewise, the statement "about X, Y, or about Z" has the same meaning as "about X, about Y, or about Z," unless indicated otherwise.

In this document, the terms "a," "an," or "the" are used to include one or more than one unless the context clearly dictates otherwise. The term "or" is used to refer to a nonexclusive "or" unless otherwise indicated. The statement "at least one of A and B" or "at least one of A or B" has the same meaning as "A, B, or A and B." In addition, it is to be understood that the phraseology or terminology employed herein, and not otherwise defined, is for the purpose of description only and not of limitation. Any use of section headings is intended to aid reading of the document and is not to be interpreted as limiting; information that is relevant to a section heading may occur within or outside of that particular section.

In the methods described herein, the acts can be carried out in any order without departing from the principles of the invention, except when a temporal or operational sequence is explicitly recited. Furthermore, specified acts can be carried out concurrently unless explicit claim language recites that they be carried out separately. For example, a claimed act of doing X and a claimed act of doing Y can be conducted simultaneously within a single operation, and the resulting process will fall within the literal scope of the claimed process.

The term "about" as used herein can allow for a degree of variability in a value or range, for example, within 10%, within 5%, or within 1% of a stated value or of a stated limit of a range, and includes the exact stated value or range.

The term "substantially" as used herein refers to a majority of, or mostly, as in at least about 50%, 60%, 70%, 80%, 90%, 95%, 96%, 97%, 98%, 99%, 99.5%, 99.9%, 99.99%, or at least about 99.999% or more, or 100%. The term "substantially free of" as used herein can mean having none or having a trivial amount of, such that the amount of material present does not affect the material properties of the composition including the material, such that the composition is about 0 wt % to about 5 wt % of the material, or about 0 wt % to about 1 wt %, or about 5 wt % or less, or less than, equal to, or greater than about 4.5 wt %, 4, 3.5, 3, 2.5, 2, 1.5, 1, 0.9, 0.8, 0.7, 0.6, 0.5, 0.4, 0.3, 0.2, 0.1, 0.01, or about 0.001 wt % or less. The term "substantially free of" can mean having a trivial amount of, such that a composition is about 0 wt % to about 5 wt % of the material, or about 0 wt % to about 1 wt %, or about 5 wt % or less, or less than, equal to, or greater than about 4.5 wt %, 4, 3.5, 3, 2.5, 2, 1.5, 1, 0.9, 0.8, 0.7, 0.6, 0.5, 0.4, 0.3, 0.2, 0.1, 0.01, or about 0.001 wt % or less, or about 0 wt %.

The term "surface" as used herein refers to a boundary or side of an object, wherein the boundary or side can have any perimeter shape and can have any three-dimensional shape, including flat, curved, or angular, wherein the boundary or side can be continuous or discontinuous.

As used herein, the term "polymer" refers to a molecule having at least one repeating unit and can include copolymers.

The term "abrasive," as used herein, refers to abrasive particles suitable for use as an abrasive coating on the surface-treating article described herein, abrasive particles within the interior of the surface-treating article, abrasive particles both on the surface and in the interior of the surface-treating article, or to resins and other polymeric materials on the surface, in the interior, or both on the surface and in the interior of the surface-treating article that have a hardness measured on the Mohs hardness scale that is greater than the hardness of the surface-treating article itself. Exemplary abrasive particles include both naturally occurring and synthetically formed particles, such as fused aluminum oxide based materials such as aluminum oxide, ceramic aluminum oxide (which may include one or more metal oxide modifiers and/or seeding or nucleating agents), heat-treated aluminum oxide, silicon carbide, co-fused alumina-zirconia, diamond, ceria, titanium diboride, cubic boron nitride, boron carbide, garnet, flint, emery, sol-gel derived abrasive particles, novaculite, pumice, rouge, sand, corundum, sandstone, tripoli, powdered feldspar, staurolite, ceramic iron oxide, glass powder, steel particles, and blends thereof. Exemplary resins and polymeric materials suitable for use as an abrasive material in the surface-treating article described herein include melamine resin, polyester resin such as the condensation product of maleic and phthalic anhydrides and propylene glycol, synthetic polymers such as styrene-butadiene (SBR) copolymers, carboxylated-SBR copolymers, phenol-aldehyde resins, polyesters, polyamides, polyureas, polyvinylidene chloride, polyvinyl chloride, acrylic acid-methylmethacrylate copolymers, acetal copolymers, polyurethanes, and mixtures and cross-linked versions thereof.

The term "single abrasive formulation," as used herein, refers material that can contain a single abrasive as defined herein or a mixture of abrasives. A single abrasive formulation can contain a distribution of abrasive particle sizes and shapes of any one of the abrasive materials described herein. The single abrasive formulation can also include fillers such as talc, calcium carbonate, etc., which can also possess abrasive properties, but can have lower abrasiveness and lower hardness than the abrasive particles described above.

As used herein, the term "free of intentionally included abrasive" refers to a region may have some small amount of adventitiously deposited abrasive due to deposition of abrasive at an adjacent region.

As used herein, the term "radius" refers to a length on a circular surface that extends from the center of the surface to another portion of the surface, or to a length that originates at a point on the circular surface that is not the center of the surface and extends to another point on the surface.

As used herein, the term "non-working region" refers to a portion of the surface-treating article that does not touch a work-surface, such as a floor, when the surface-treating article is used to, for example, abrade or polish the work-surface.

As used herein, the term "working region" refers to a portion of the surface-treating article that is in contact with a work-surface, such as a floor, when the surface-treating article is used to, for example, abrade or polish the work-surface.

Surface-Treating Article.

In some embodiments, a surface-treating article is provided. The surface-treating article includes a circular substrate with a first major surface and an abrasive disposed on the first major surface. The abrasive has a first concentration at a first radius measured from the center of the substrate, and the abrasive has a second concentration not equal to the first concentration at a second radius measured from the center of the substrate, where the first radius and the second radius have different lengths. In some embodiments, the surface-treating article has a working region and a non-working region.

A surface-treating article according to some embodiments is shown in FIG. 1*a*. In FIG. 1*a*, circular substrate (100) has a first radius (110) and a second radius (120), where the second radius is longer than the first radius. The two radii define an abrasive region (130) that has a first concentration at the edge corresponding to the end point of the first radius and a second concentration at the edge corresponding to the endpoint of the second radius. The concentration gradient in the abrasive region (130) can either increase from the first concentration to the second concentration (i.e. the first concentration is lower than the second concentration), or decrease from the first concentration to the second concentration (i.e. the first concentration is higher than the second concentration). The circular substrate (100) has a central region (140) that does not have any intentionally deposited abrasive. The pattern in FIG. 1*a* only indicates where abrasive is disposed on the surface-treating article, but does not illustrate a gradient of abrasive at different radii on the circular substrate.

The circular substrate can have any size that is suitable for the abrading, scouring, finishing, sanding, or polishing applications that it is used for. In some embodiments, the substrate can have a diameter of about 1 inch to about 50 inches, or about 4 inches to about 40 inches, or about 5 inches to about 30 inches, or about 6 inches to about 20 inches, or any range or sub-range between these values. In some embodiments, the substrate has a diameter of 1, 2, 4, 6, 8, 10, 12, 14, 16, 18, 20, 25, 30, 35, 40, 45, or 50 inches, or any range or sub-range between these values. In some embodiments, the substrate has a diameter of about 12 inches to about 27 inches. In some embodiments, the substrate has a diameter of about 4 inches to about 27 inches. The circular substrate can have a thickness ranging from about 0.01 inches to about 1 inches, about 0.1 inches to about 0.9 inches, about 0.2 inches to about 0.8 inches, about 0.3 inches to about 0.7 inches, or about 0.3 inches to about 0.6 inches, or ay range or sub-range between these values. In some embodiments, the circular substrate has a thickness 0.05, 0.1, 0.15, 0.2, 0.3, 0.4, 0.5, 0.6, 0.7, 0.8, 0.9, or 1.0 inches, or any range or sub-range between these values. In some embodiments, the substrate has a thickness of about 0.25 inches to about 1 inch. In some embodiments, the substrate has a thickness of about 0.025 inches to about 0.07 inches.

The substrate can include a web open, lofty, three-dimensional nonwoven fibers, including natural and synthetic fibers. In some embodiments, the substrate comprises natural fiber (e.g., vegetable fibers such as hemp, jute, and the like; animal hair fibers, such as hog's hair), a polyamide (e.g., a nylon), a polyester (e.g., polyethylene terephthalate or polyethylene isophthalate), rayon, polyethylene, polypropylene, a synthetic fiber, or a combination thereof. Synthetic fibers include polymers derived from natural sources, such as polylactic acid derived from corn. The substrate can be a non-woven web, including a plurality of fibers, which are adhered to each other at their joints of mutual contact by a binder and/or by being melt-bonded. In other instances, the substrate can be a variety of materials, including paper, woven fabrics, nonwoven fabrics, calendared nonwoven fabrics, polymeric films, stitch-bonded fabrics, open cell foams, closed cell foams, and combinations thereof.

In some embodiments, the abrasive includes abrasive grains. The abrasive grains can be any of the abrasive particle materials described herein, such as aluminum oxide, ceramic aluminum oxide, heat-treated aluminum oxide, silicon carbide, co-fused alumina-zirconia, diamond, ceria, titanium diboride, cubic boron nitride, boron carbide, garnet, flint, emery, sol-gel derived abrasive particles, novaculite, pumice, rouge, sand, corundum, sandstone, tripoli, powdered feldspar, staurolite, ceramic iron oxide, glass powder, steel particles, and blends thereof. In some embodiments, the abrasive is a single abrasive formulation. The abrasive can also include resins. Exemplary resins suitable for use as an abrasive material in or on a major surface of the surface-treating article described herein include melamine resin, polyester resin such as the condensation product of maleic and phthalic anhydrides and propylene glycol, synthetic polymers such as styrene-butadiene (SBR) copolymers, carboxylated-SBR copolymers, phenol-aldehyde resins, polyesters, polyamides, polyureas, polyvinylidene chloride, polyvinyl chloride, acrylic acid-methylmethacrylate copolymers, acetal copolymers, polyurethanes, and mixtures and cross-linked versions thereof.

In some embodiments, the substrate further includes a second major surface. The second major surface, in some embodiments, can be the side of the surface-treating article opposite to the first major surface. The second major surface can have any suitable abrasive described herein disposed on it. In some embodiments, the second major surface has a greater hardness than the substrate as measured on Mohs scale. The second major surface can have disposed on it any abrasive suitable for use in the first major surface, including melamine resin, polyester resin such as the condensation product of maleic and phthalic anhydrides and propylene glycol, synthetic polymers such as styrene-butadiene (SBR) copolymers, carboxylated-SBR copolymers, phenol-aldehyde resins, polyesters, polyamides, polyureas, polyvinylidene chloride, polyvinyl chloride, acrylic acid-methylmethacrylate copolymers, acetal copolymers, polyurethanes, and mixtures and cross-linked versions thereof. The substrate can also have resin or polymeric materials disposed within the interior of the surface-treating article. The resin or polymeric material can give the surface-treating article additional structural rigidity and provides finishing capability.

The abrasive or single abrasive formulation can be applied to the surface of the substrate in a coating using any suitable coating techniques, such as spray coating or roll coating. In some instances, particularly where the substrate is porous, when the abrasive is disposed on the first major surface or second major surface of the surface-treating article, it may penetrate into the interior of the surface-treating article to a depth less than the thickness of the surface-treating article. In some embodiments, at least some of the abrasive or single abrasive formulation can be present in the interior of or throughout the surface-treating article. The abrasive or single abrasive formulation can be present on the first major surface, the second major surface, the interior of the surface-treating article, or any combination thereof. The coating containing the abrasive or single abrasive formulation can be deposited on the first or second major surface of the surface-treating article so that a radially non-uniform gradient of the abrasive or single abrasive formulation is formed.

The coating can include the abrasive or single abrasive formulation, together with binders, fillers, crosslinkers, or other additives suitable for use in such substrates. Suitable additives can include an organic solvent, a surfactant, an emulsifier, a dispersant, a crosslinking agent, a catalyst, a rheology modifier, a density modifier, a cure modifier, a free radical initiator, a diluent, an antioxidant, a heat stabilizer, a flame retardant, a plasticizer, filler, a polishing aid, an inorganic particle, a pigment, a dye, an adhesion promoter, antistatic additives, or a combination thereof. The coating can be a curable coating composition.

In some embodiments, the first concentration and second concentration of the abrasive are greater than zero. In some embodiments, the first concentration is greater than the second concentration. In some embodiments, the second concertation is greater than the first concentration.

The ratio of the first concentration to the second concentration can range from about 10:1 to about 1:10. In some embodiments, the ratio of the first concentration to the second concentration can range from about 9:1 to about 1:9, from about 8:1 to about 1:8, from about 7:1 to about 1:7, from about 6:1 to about 1:6, from about 5:1 to about 1:5, from about 4:1 to about 1:4, from about 3:1 to about 1:3, from about 2:1 to about 1:2, or any range or sub-range between these values. In some embodiments, the ratio of the first concentration to the second concentration can range from about 2:1 to about 1.1:1. In some embodiments, ratio of the first concentration to the second concentration can range from about 1.8:1 to about 1.4:1. In some embodiments, the ratio of the first concentration to the second concentration ranges from about 1:1.2 to about 1:2.2. In some embodiments, the ratio of the first concentration to the second concentration ranges from about 1:1.5 to about 1:2.

In some embodiments, the length of the first radius is less than the length of the second radius. In some embodiments, the second radius extends from the edge of the substrate to the end of the first radius. The first radius or the second radius can be from about 0.5 to about 25 inches, about 2 to about 21, about 3 to about 19, about 4 to about 17, about 5 to about 16, about 6 to about 13, or about 7 to about 11 inches in length. In some embodiments, the first radius is about 1, 2, 3, 4, 5, 6, 7, 8, 9, 10, 11, or about 12 inches in length. In some embodiments, the second radius is about 1, 2, 3, 4, 5, 6, 7, 8, 9, 10, 11, or about 12 inches in length. In some embodiments, the ratio of the first concentration to the second concentration ranges in a gradient distribution.

Figure 4A:
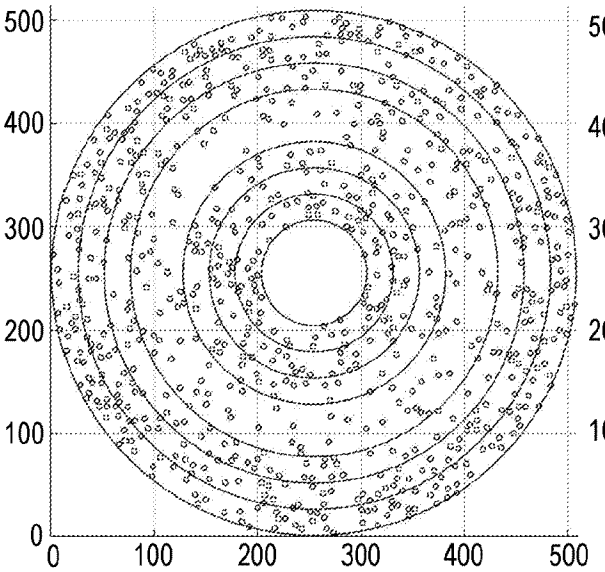
FIG. 4*a* is a radially non-uniform random gradient distribution of 800 grains on a circular pad, where the center and edge of the pad have higher concentration of the abrasive grains, in accordance with various embodiments.
Figure 4B:
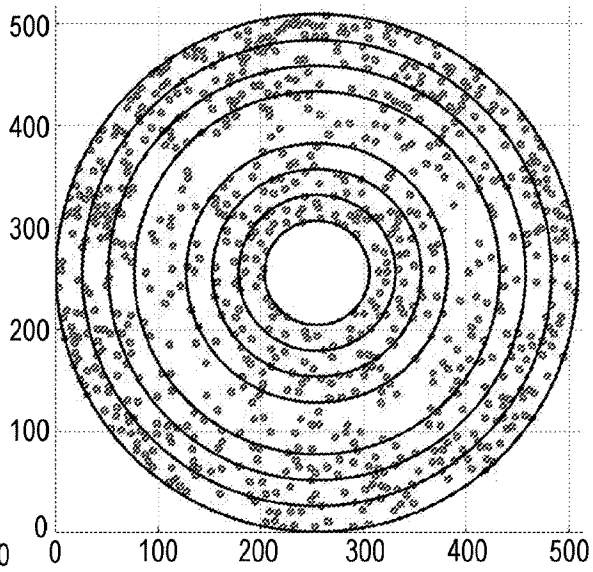
FIG. 4*b* is a radially non-uniform random gradient distribution of 800 grains on a circular pad, where the center and edge of the pad have higher concentration of the abrasive grains, in accordance with various embodiments.
Figure 4C:
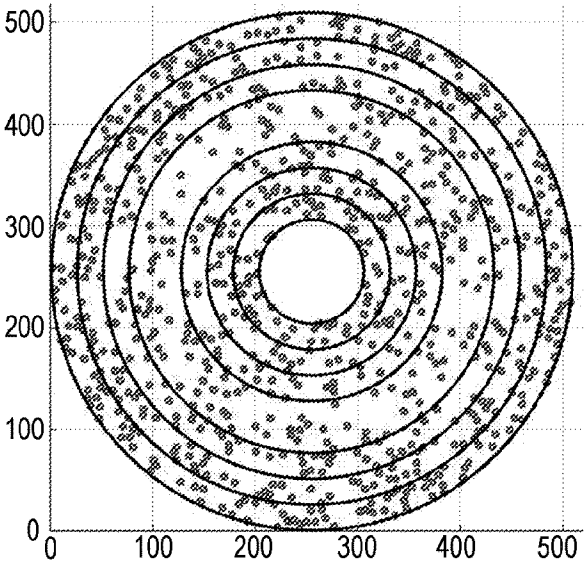
FIG. 4*c* is a radially non-uniform random gradient distribution of 800 grains on a circular pad, where the center and edge of the pad have higher concentration of the abrasive grains, in accordance with various embodiments.
Figure 4D:
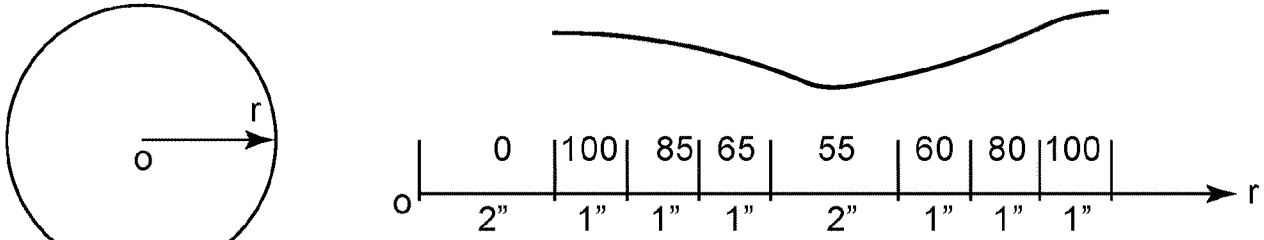
FIG. 4*d* is the radial distribution of abrasive grains, from the center of the pad (0) to the edge of the pad (r), in accordance with various embodiments.

In some embodiments, a concentration of the abrasive at the first radius to the second radius decreases from the first concentration in a gradient distribution to the second concentration. For example, FIG. 4*d* depicts a concentration gradient where the first concentration at a radius of 2 inches decreases along a gradient to a lower concentration at a radius of 6 inches.

In some embodiments, a concentration of the abrasive at the first radius to the second radius increases from the first concentration in a gradient distribution to the second concentration. For example, FIG. 3*d* depicts a concentration gradient where the first concentration at a radius of 2 inches increases along a gradient to a higher concentration at a radius of 6 inches.

In some embodiments, the first concentration or the second concentration is a maximum abrasive concentration of the first major surface of the surface-treating article. In some embodiments, the first concentration or the second concentration is a minimum abrasive concentration of the first major surface of the surface-treating article. FIGS. 2*d* and 3*d* show both maximum and minimum first concentrations and second concentrations. In FIGS. 2*d* and 3*d*, the maximum concentration has been normalized to a value of 100.

Figure 3A:
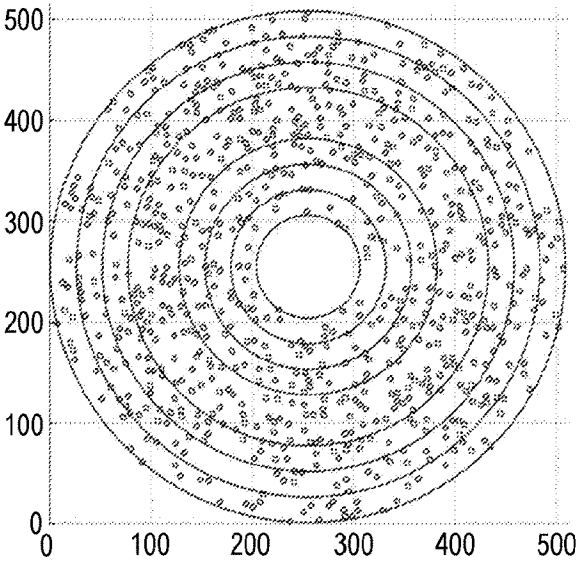
FIG. 3*a* is a radially non-uniform random gradient distribution of 800 grains on a circular pad, where the center and edge of the pad have lower concentration of abrasive grains, in accordance with various embodiments.
Figure 3B:
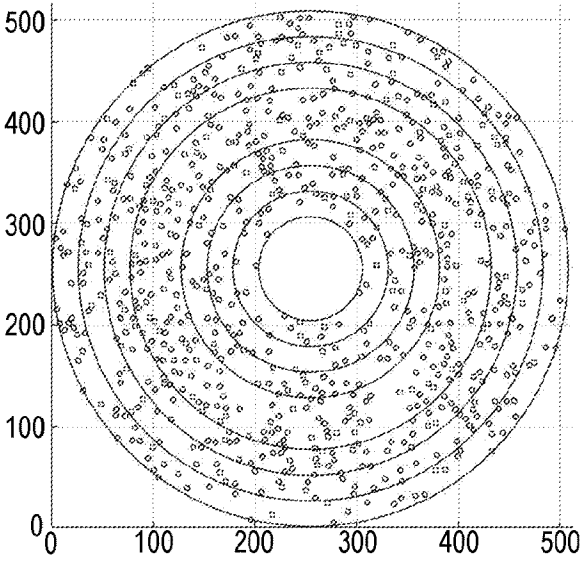
FIG. 3*b* is a radially non-uniform random gradient distribution of 800 grains on a circular pad, where the center and edge of the pad have lower concentration of abrasive grains, in accordance with various embodiments.
Figure 3C:
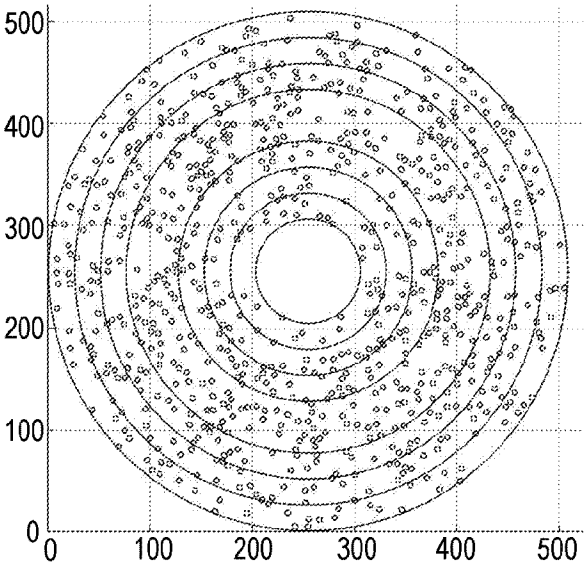
FIG. 3*c* is a radially non-uniform random gradient distribution of 800 grains on a circular pad, where the center and edge of the pad have lower concentration of abrasive grains, in accordance with various embodiments.
Figure 3D:
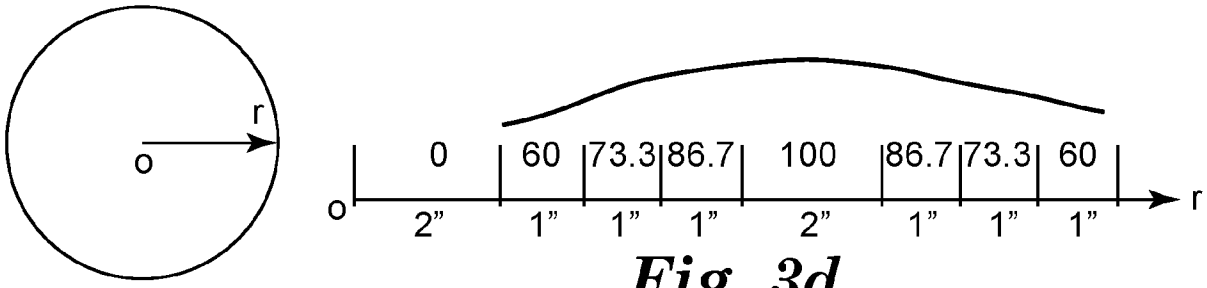
FIG. 3*d* is the radial distribution of abrasive grains, from the center of the pad (0) to the edge of the pad (r), in accordance with various embodiments. T

FIG. 3*d* shows a first concentration that is a minimum, and a second concentration that is a maximum. In FIG. 3*d* the minimum concentration is 60% of the maximum concentration. FIG. 4*d* shows a first concentration that is a maximum, and a second concentration that is a minimum. In FIG. 4*d* the minimum concentration is 55% of the maximum concentration.

In some embodiments, the first major surface includes a central region substantially free of intentionally included abrasive. The central region of the first major surface is the portion of the surface-treating article that is mounted on or attached to a machine or apparatus adapted to rotate and/or translate the surface-treating article to effect abrading or polishing a work-surface. When the surface-treating article is configured the on the machine or apparatus, the central region can be punched out. For this reason depositing any abrasive on this region is economically wasteful. The area of the central region can be from about 1% to about 15%, about 2% to about 13%, about 3% to about 11%, or about 4% to about 9% of the total area of the surface treating article. In some embodiments, the central region can be 1%, 2%, 3%, 4%, 5%, 6%, 7%, 8%, 9%, 10%, 11%, 12%, 13%, 14%, or 15% of the total surface area of the surface-treating article, or any range or sub-range in between these values.

In some embodiments, the surface-treating article further includes an abrasive having a third concentration at a third radius measured from the center of the substrate. In some embodiments, the first and third concentrations are both greater than the second concentration, and the length of the second radius is between the length of the first radius and the third radius. In some embodiments, the first and third concentrations are both less than the second concentration, and the length of the second radius is between the length of the first radius and the third radius.

The gradient distribution of the abrasive can have a sinusoidal or parabolic shape, such that the maximum abrasive concentration occurs at the first concentration and the first radius, the minimum concentration occurs at a second concentration and the second radius, and a maximum concentration occurs at a third concentration and the third radius. The gradient distribution of the abrasive can also have a sinusoidal or parabolic shape, such that the minimum abrasive concentration occurs at the first concentration and the first radius, the maximum concentration occurs at a second concentration and the second radius, and the minimum concentration occurs at a third concentration and the third radius.

Figure 1B:
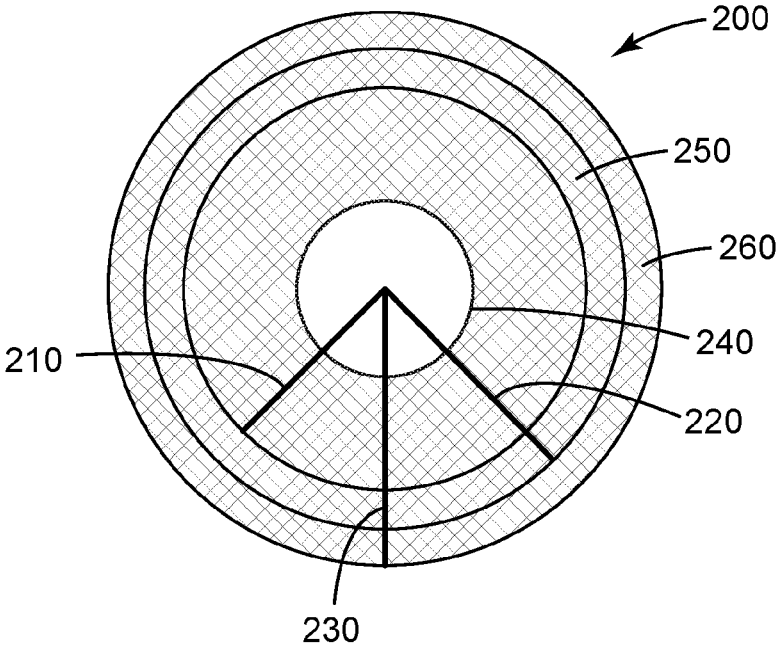
FIG. 1*b* is a schematic of the surface-treating article showing a region with a first, second, and third abrasive concentration, in accordance with various embodiments.

A surface-treating article having a first, second, and third concentration and radius is shown in FIG. 1*b*. In FIG. 1*b*, circular substrate (200) has a first radius (210), a second radius (220), and a third radius (230), where the second radius is longer than the first radius, and the third radius is longer than the second radius. The three radii define abrasive regions (250 and 260) that have a first concentration at the edge corresponding to the end point of the first radius, a second concentration at the edge corresponding to the endpoint of the second radius, and a third concentration at the edge corresponding to the endpoint of the third radius. The concentration gradient in the abrasive region (250) can either increase from the first concentration to the second concentration (i.e. the first concentration is lower than the second concentration), or decrease from the first concentration to the second concentration (i.e. the first concentration is higher than the second concentration). Similarly the concentration in the abrasive region (260) can either increase from the second concentration to the third concentration (i.e. the second concentration is lower than the third concentration), or decrease from the second concentration to the third concentration (i.e. the second concentration is higher than the third concentration). The circular substrate (200) has a central region (240) that does not have any intentionally deposited abrasive. The pattern in FIG. 1*b* only indicates where abrasive is disposed on the surface-treating article, but does not illustrate a gradient of abrasive at different radii on the circular substrate.

The number of regions having a particular abrasive concentration is not limited, so that the surface-treating article can have a fourth concentration at a fourth radius, a fifth concentration at a fifth radius, and so forth. In some embodiments, the concentration of abrasive can also be substantially zero at a particular radius, so that the surface-treating article can include regions of abrasive with a gradient distribution interspersed with regions where no abrasive is intentionally deposited. Regions having no abrasive can still have small adventitious amounts of abrasive at the edge where the abrasive-free region meets a region containing abrasive.

In some embodiments, the surface-treating article includes a circular substrate that can include natural fiber, a polyamide, a polyester, rayon, polyethylene, polypropylene, or a combination thereof and having a first major surface. The first major surface includes a single abrasive formulation having a first concentration at a first radius, and a single abrasive formulation having a second concentration at a second radius that is a different length than the first radius, where the ratio of the first concentration to the second concentration ranges from about 2:1 to about 1.1:1.

In some embodiments, the surface-treating article includes a circular substrate that can include natural fiber, a polyamide, a polyester, rayon, polyethylene, polypropylene, or a combination thereof and having a first major surface. The first major surface includes a single abrasive formulation having a first concentration at a first radius, and a single abrasive formulation having a second concentration at a second radius that is a different length than the first radius, where the ratio of the first concentration to the second concentration ranges from about 1:1.2 to about 1:2.2.

In some embodiments, a surface-treating article for controlling the amount of material removed from a work-surface is provided. The surface-treating article includes a circular substrate having a first major surface. The first major surface includes an abrasive having a first concentration at a first radius measured from the center of the substrate, and the abrasive having a second concentration not equal to the first concentration at a second radius measured from the center of the substrate that is a different length than the first radius, where the amount of material removed from a work-surface by the surface-treating article is a function of the difference between the first concentration and the second concentration.

In some embodiments, the pattern of material removed from the work-surface by the surface-treating article is a function of the difference between the first concentration and the second concentration. The overall pattern of material removed from the work-surface is produce by a combination of regions of lower first concentration and higher second concentration or regions of higher first concentration and lower second concentration. As, discussed herein, there is no limitation as to the number of regions on the surface-treating article, and the pattern of material removed from the work-surface will also depend on the number of non-radial abrasive gradient distributions on the entire surface of the surface-treating article.

The work-surface can be any surface that requires controlled removal of material such as wood, stone, metal, ceramic, glass, mineral, cured polymer, or combinations thereof.

The work-surface can include resilient floor, vinyl composition tile (VCT) tile, laminate, hardwood, seamless polymer floor, etc. and surfaces that have been treated with coatings.

EXAMPLES

Various embodiments of the present invention can be better understood by reference to the following Examples which are offered by way of illustration. The present invention is not limited to the Examples given herein.

Modeling.

Modeling was used to simulate the situation of a floor pad scrubbing on the floor. A 20 inch circular pad with uniform abrasive grain distribution was calculated first. The pad self-rotational speed of 200 rpm and its translational speed of 72 feet per minute were used in the modeling to simulate the actual conditions of a floor pad under the floor scrubbing machine.

Comparative Example 1

A pad having a uniform abrasive grain distribution was modeled. There were 800 abrasive grains in total and three randomizations of the abrasive grains were generated.

Three random uniform abrasive grain distributions on a circular pad are shown in FIGS. 1*a*-1*c*. FIG. 2*d* shows a representative modeling result. The pad was rotated courter clock-wise at a speed of 200 rpm and a translational speed of 72 feet per minute (to the right). One side of the pad has higher density of scratches, and both center and edge of the pad have lower density of the pad. A pad with uniform abrasive grain distribution does not provide a uniform scratch pattern on the floor.

Example 2

A pad having a radially non-uniform abrasive grain distribution was modeled. There were 800 abrasive grains in total and three randomizations of the abrasive grains were generated.

Figure 2C:
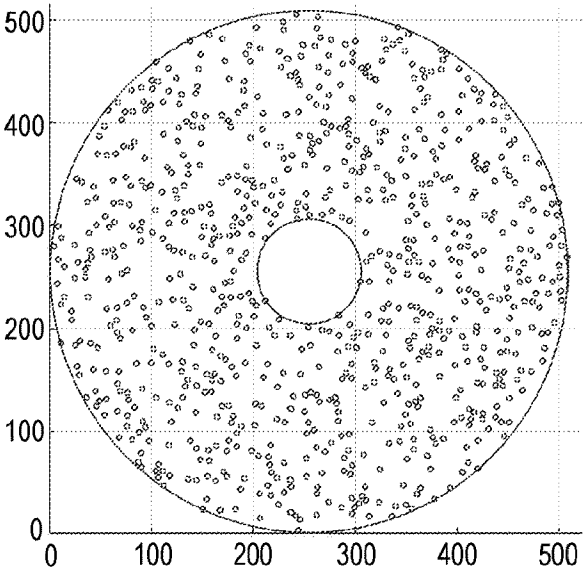
FIG. 2*c* is a uniform random grain distribution of 800 grains on a circular pad.
Figure 2B:
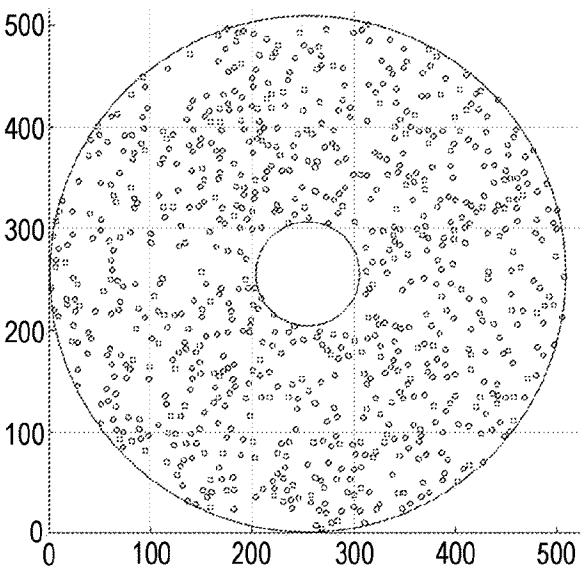
FIG. 2*b* is a uniform random grain distribution of 800 grains on a circular pad.
Figure 2A:
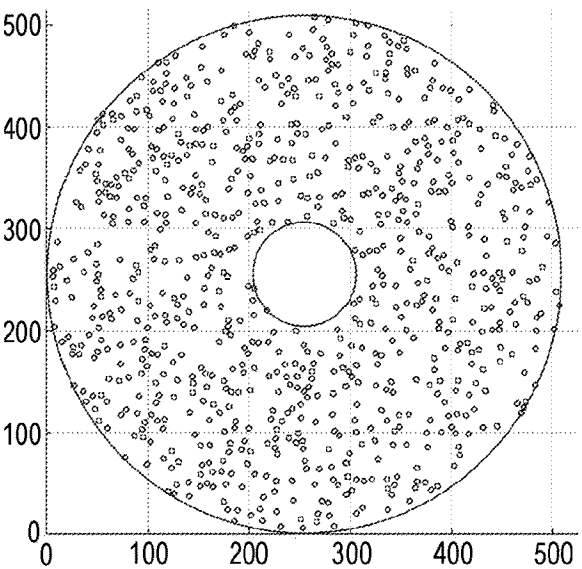
FIG. 2*a* is a uniform random grain distribution of 800 grains on a circular pad.
Figure 2D:
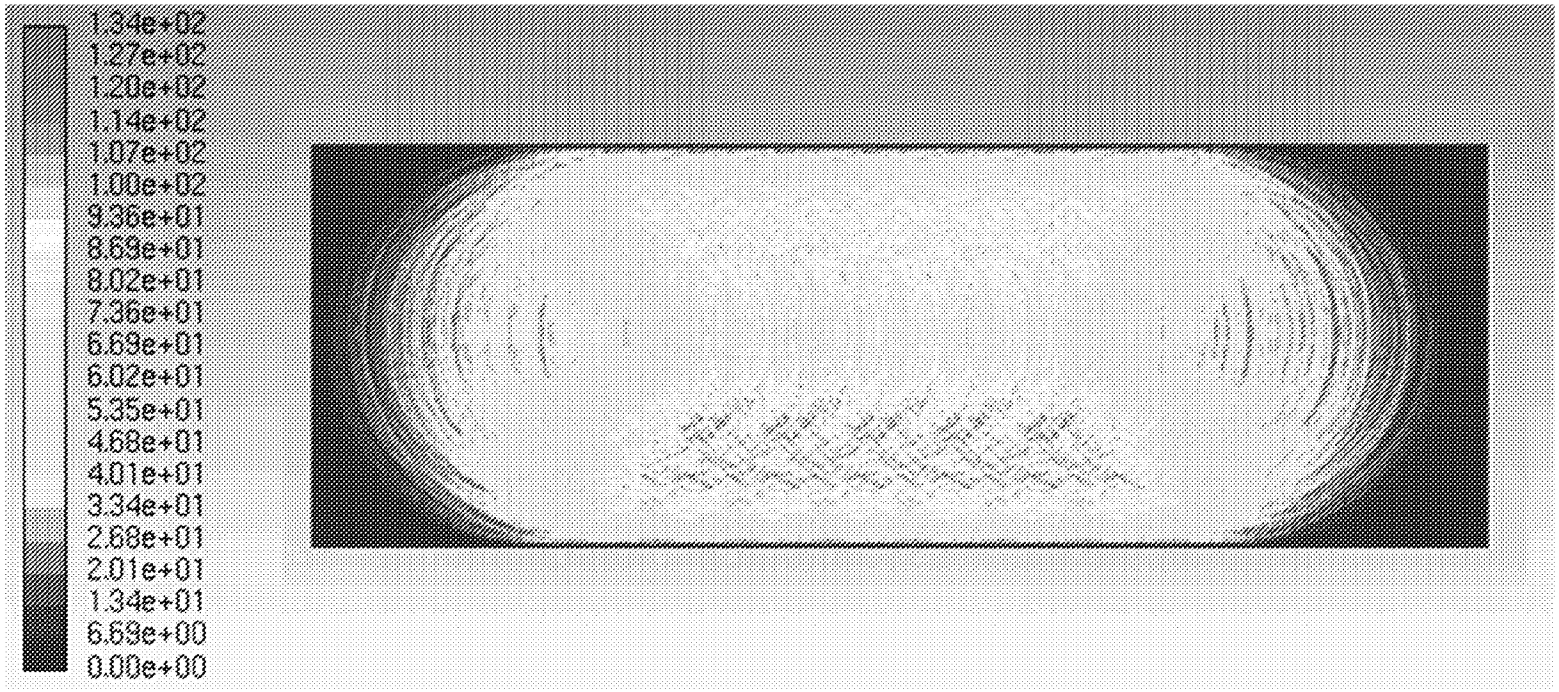
FIG. 2*d* is a representative modeling result of the scratch pattern of a uniform grain distribution of 800 grains on the circular pad, in accordance with various embodiments.

Three random radially non-uniform random gradient distributions on a circular pad are shown in FIGS. 2*a*-2*c*. The center and edge of the pad have lower concentration of abrasive grains than the middle portion of the pad.

The radial distribution of abrasive grains, from the center of the pad (0) to the edge of the pad (r), is shown in FIG. 3*d*. The distribution is gradient distribution having a normalized maximum abrasive grain concentration at the portion in the distribution curve marked 100. The abrasive grain concentration decreases on either side of the maximum point in a continuous gradient.

Figure 3E:
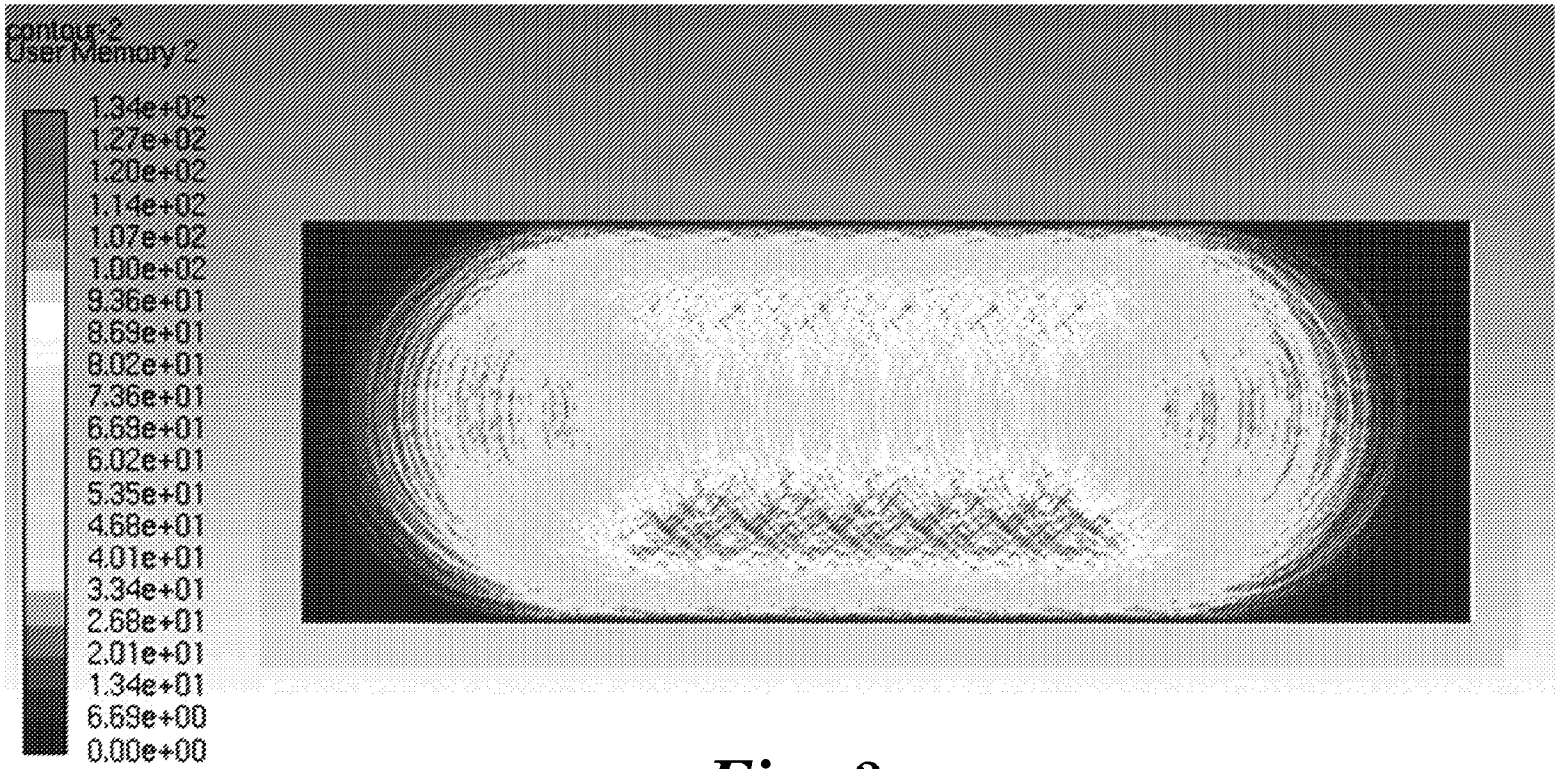
FIG. 3*e* is a representative modeling result of the scratch pattern of a radially non-uniform grain distribution of 800 grains on the circular pad, according to some embodiments.

A representative modeling result of the scratch pattern of a radially non-uniform grain distribution of 800 grains on a circular pad is shown in FIG. 3*e*. The pad was rotated courter clock-wise at a speed of 200 rpm and a translational speed of 72 feet per minute (to the right). This embodiment shows a higher density of scratches in the middle (between center and edge of the pad), which is the most effective working area.

Example 3

A pad having a radially non-uniform abrasive grain distribution was modeled. There were 800 abrasive grains in total and three randomizations of the abrasive grains were generated.

Three random radially non-uniform random gradient distributions on a circular pad are shown in FIGS. 3*a*-3*c*. The center and edge of the pad have higher concentration of the abrasive grains than the middle portion of the pad.

The radial distribution of abrasive grains, from the center of the pad (0) to the edge of the pad (r), is shown in FIG. 4*d*. The distribution is gradient distribution having a normalized maximum abrasive grain concentration at the portions in the distribution curve marked 100. The abrasive grain concentration decreases between the maximum points in a continuous gradient.

Figure 4E:
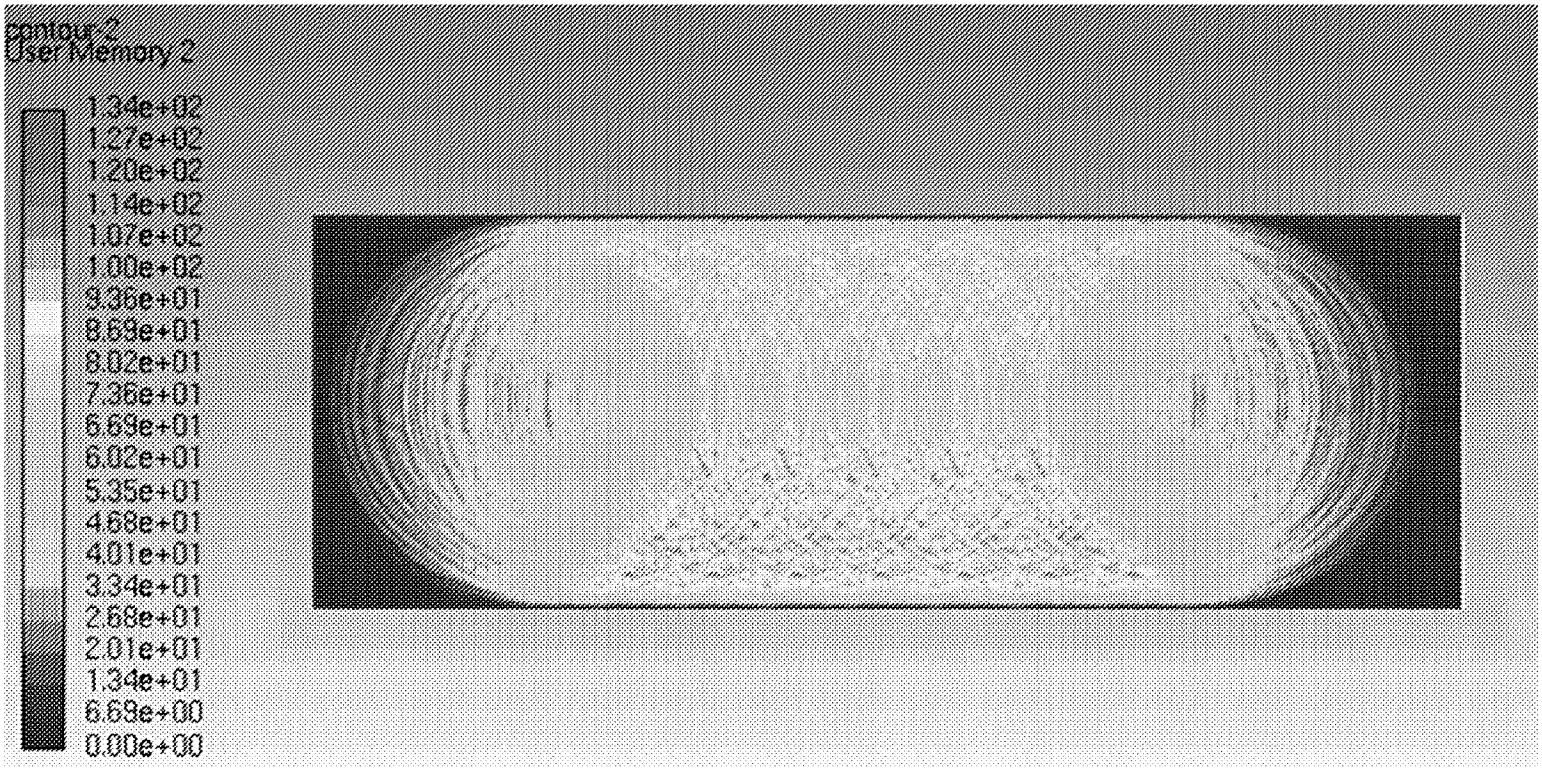
FIG. 4*e* is a representative modeling result of the scratch pattern of a radially non-uniform grain distribution of 800 grains on the circular pad, according to some embodiments.

A representative modeling result of the scratch pattern of a radially non-uniform grain distribution of 800 grains on the circular pad is shown in FIG. 4*e*. The pad is rotated courter clock-wise at a speed of 200 rpm and a translational speed of 72 feet per minute (to the right). This embodiment shows a more uniform distribution of scratches, which will allow a more uniform appearance on the floor.

Figure 5:
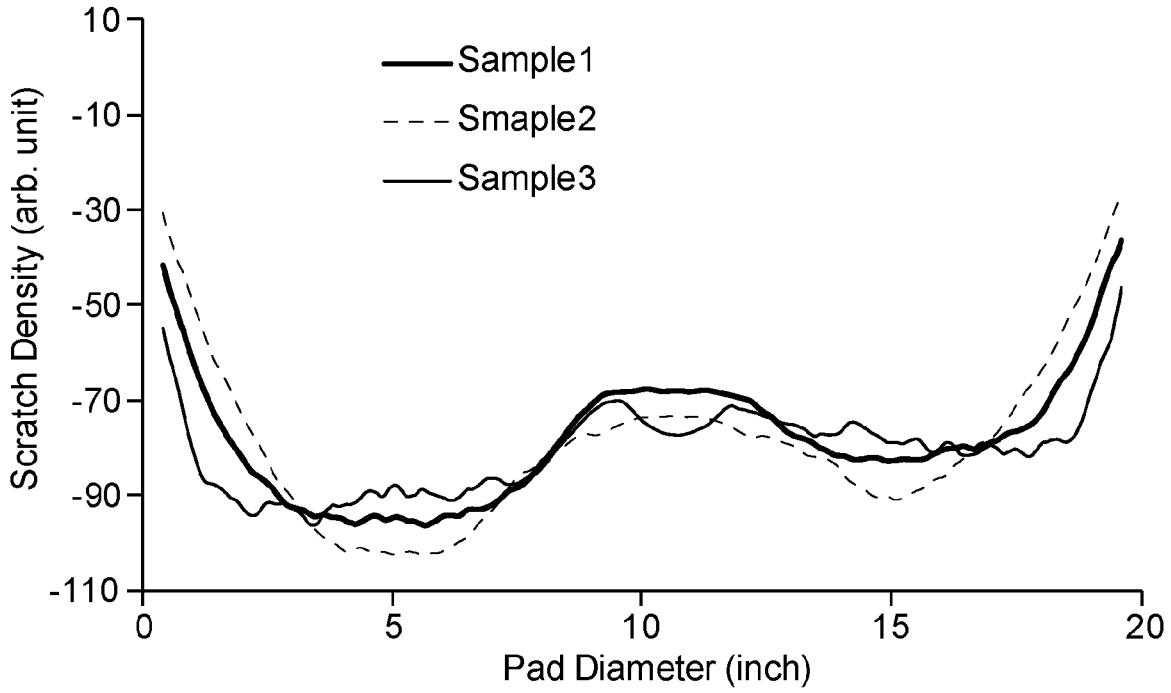
FIG. 5 is a plotted the density of scratches on the floor across the pad for a comparative pad (Sample 1) and two pads according to some embodiments (Samples 2 and 3).

The density of scratches on a floor is shown in FIG. 5. FIG. 5 plots Sample 1 (uniform grain distribution), Sample 2 (radially non-uniform gradient distribution with maximum abrasive concentration in the middle of the pad and minimum abrasive concertation at the center and edge of the pad), and Sample 3 (radially non-uniform gradient distribution with minimum abrasive concentration in the middle of the pad and maximum abrasive concertation at the center and edge of the pad). Standard deviations for Samples 1, 2, and 3 are 14.05, 18.55, and 9.48, respectively. The scratch pattern of Sample 3 is more uniform across the floor with smaller standard deviation, Sample 2 with more abrasive grains in the middle of the pad showed more scratches in the most effective working zone.

Example 4. Sample Preparation

3M™ Aqua™ 3100 Floor Pad (20 inches) were used as a starting material. Such pads are available from 3M Company, St. Paul, MN, USA. The fibers constituting the pad are held together at their points of mutual contact by a primary polymer resin. The pad is flexible and resilient and contains polyester fibers.

A homogenous polymer resin mixture was prepared, consisting of 292.5 grams of Phenol resin BB077a (available from Arclin USA, LLC, Roswell, Georgia., 300076), 511.2 grams of aluminum oxides 240f (available from Washington Mills, Niagara Falls, NY, 14302), and 196.3 grams of water. The resin mixture was evenly sprayed onto one of the surfaces of the 20 inch floor pad by hand using a standard type compressed air spray gun (normally used for spraying paint) with above mixture. The wet (uncured resin) add-on weight thereafter weighed 81 grams.

Testing.

The test area was prepared by coating a bare vinyl composition tile (VCT) floor with 4 coats of Signature floor finish (available from Sealed Air, Charlotte, NC, 28273) at a rate of 2000 sq. ft per gallon and allowed to cure 2 days before testing. Each of Examples was mounted on a Tennant T300 auto scrubber filled with water only. After conditioning the pad by running for 15 linear feet, the sample was used to scrub a test lane at ~72 feet per minute at the high-pressure setting.

Figure 6:
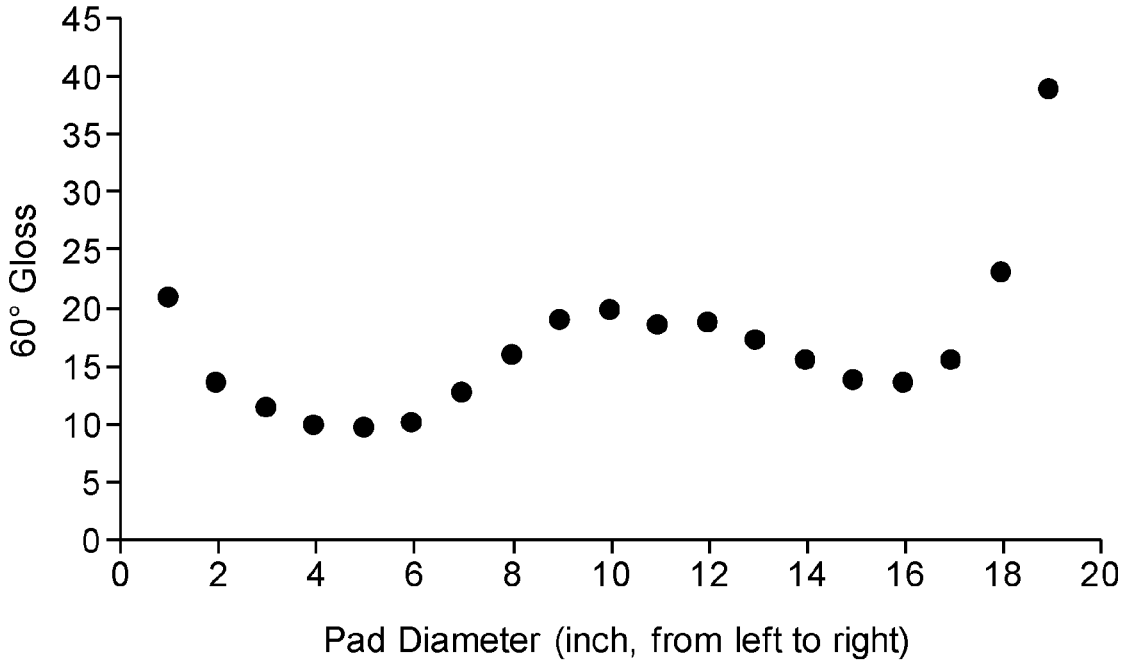
FIG. 6 is a plot of 60° gloss across the test lane on a vinyl composition tile (VCT) tile with signature floor finish after scrubbing with a floor pad having uniform abrasive grain distribution.

A series of 60° Gloss measurements were taken using a Rhopoint IQ 20/60 meter. The meter was aligned perpendicular to the test lane and 19 readings were taken at intervals of 1" across the width of the test lane. The meter was also aligned parallel to the test lane and 19 readings were taken at intervals of 1" across the width of the test lane. FIG. 6 plotted the 60° gloss data across the test lane.

The modeling data of the floor pad with uniform abrasive gain distribution (Sample 1 in FIG. 5) matched very well with this experimental data on 60° Gloss. FIG. 6 is a plot of 60° Gloss across the test lane on a vinyl composition tile (VCT) tile with signature floor finish after scrubbing with a floor pad having uniform abrasive grain distribution.

The terms and expressions that have been employed are used as terms of description and not of limitation, and there is no intention in the use of such terms and expressions of excluding any equivalents of the features shown and described or portions thereof, but it is recognized that various modifications are possible within the scope of the embodiments of the present invention. Thus, it should be understood that although the present invention has been specifically disclosed by specific embodiments and optional features, modification and variation of the concepts herein disclosed may be resorted to by those of ordinary skill in the art, and that such modifications and variations are considered to be within the scope of embodiments of the present invention.

Embodiment 1 provides a surface-treating article, comprising: a circular substrate comprising a first major surface; an abrasive disposed on the first major surface; the abrasive having a first concentration at a first radius measured from the center of the substrate, the abrasive having a second concentration not equal to the first concentration at a second radius measured from the center of the substrate, wherein the first radius and the second radius are different lengths.

Embodiment 2 provides the he surface-treating article of embodiment 1, wherein the substrate comprises a web of open, lofty, nonwoven fibers.

Embodiment 3 provides the surface-treating article of embodiments 1-2, wherein the substrate comprises natural fiber, a polyamide, a polyester, rayon, polyethylene, polypropylene, a synthetic fiber, or a combination thereof.

Embodiment 4 provides the surface-treating article of embodiments 1-3, wherein the abrasive comprises abrasive grains.

Embodiment 5 provides the surface-treating article of embodiments 1-4, wherein the abrasive is a single abrasive formulation.

Embodiment 6 provides the surface-treating article of embodiments 1-5, wherein the substrate further comprises a second major surface.

Embodiment 7 provides the surface-treating article of embodiments 1-6, wherein the second major surface has a greater hardness than the substrate.

Embodiment 8 provides the surface-treating article of embodiments 1-7, wherein the first concentration and second concentration are greater than zero.

Embodiment 9 provides the surface-treating article of embodiments 1-8, wherein the length of the first radius is less than the length of the second radius.

Embodiment 10 provides the surface-treating article of embodiments 1-9, wherein the second radius extends from the edge of the substrate to the end of the first radius.

Embodiment 11 provides the surface-treating article of embodiments 1-10, wherein the first concentration is greater than the second concentration.

Embodiment 12 provides the surface-treating article of embodiments 1-11, wherein the second concertation is greater than the first concentration.

Embodiment 13 provides the surface-treating article of embodiments 1-12, wherein a concentration of the abrasive at the first radius to the second radius decreases from the first concentration in a gradient distribution to the second concentration.

Embodiment 14 provides the surface-treating article of embodiments 1-13, wherein a concentration of the abrasive at the first radius to the second radius increases from the first concentration in a gradient distribution to the second concentration.

Embodiment 15 provides the surface-treating article of embodiments 1-14, wherein the first concentration or the second concentration is a maximum abrasive concentration of the first major surface of the surface-treating article.

Embodiment 16 provides the surface-treating article of embodiments 1-15, wherein the first concentration or the second concentration is a minimum abrasive concentration of the first major surface of the surface-treating article.

Embodiment 17 provides the surface-treating article of embodiments 1-16, wherein the first major surface comprises a central region substantially free of intentionally included abrasive.

Embodiment 18 provides the surface-treating article of embodiments 1-17, wherein the ratio of the first concentration to the second concentration ranges from about 10:1 to about 1:10.

Embodiment 19 provides the surface-treating article of embodiments 1-18, wherein the ratio of the first concentration to the second concentration ranges in a gradient distribution.

Embodiment 20 provides the surface-treating article of embodiments 1-19, wherein the ratio of the first concentration to the second concentration ranges from about 2:1 to about 1.1:1.

Embodiment 21 provides the surface-treating article of embodiments 1-20, wherein the ratio of the first concentration to the second concentration ranges from about 1.8:1 to about 1.4:1.

Embodiment 22 provides the surface-treating article of embodiments 1-21, wherein the ratio of the first concentration to the second concentration ranges from about 1:1.2 to about 1:2.2.

Embodiment 23 provides the surface-treating article of embodiments 1-22, wherein the ratio of the first concentration to the second concentration ranges from about 1:1.5 to about 1:2

Embodiment 24 provides the surface-treating article of embodiments 1-23, further comprising an abrasive having a third concentration at a third radius measured from the center of the substrate.

Embodiment 25 provides the surface-treating article of embodiments 1-24, wherein the first and third concentrations are both greater than the second concentration, and the length of the second radius is between the length of the first radius and the third radius.

Embodiment 26 provides the surface-treating article of embodiments 1-25, wherein the first and third concentrations are both less than the second concentration, and the length of the second radius is between the length of the first radius and the third radius.

Embodiment 27 provides a surface-treating article, comprising: a circular substrate comprising natural fiber, a polyamide, a polyester, rayon, polyethylene, polypropylene, or a combination thereof and having a first major surface; a single abrasive formulation disposed on the first major surface; the single abrasive formulation having a first concentration at a first radius, the single abrasive formulation having a second concentration at a second radius that is a different length than the first radius, wherein a ratio of the first concentration to the second concentration ranges from about 2:1 to about 1.1:1.

Embodiment 28 provides a surface-treating article, comprising: a circular substrate comprising natural fiber, a polyamide, a polyester, rayon, polyethylene, polypropylene, or a combination thereof and having a first major surface; a single abrasive formulation disposed on the first major surface; the single abrasive formulation having a first concentration at a first radius measured from the center of the substrate; the single abrasive formulation having a second concentration at a second radius measured from the center of the substrate that is a different length than the first radius, wherein a ratio of the first concentration to the second concentration is 1:1.2 to about 1:2.2.

Embodiment 29 provides a surface-treating article for controlling the amount of material removed from a work-surface, comprising: a circular substrate comprising a first major surface; an abrasive disposed on the first major surface; the abrasive having a first concentration at a first radius measured from the center of the substrate, the abrasive having a second concentration not equal to the first concentration at a second radius measured from the center of the substrate that is a different length than the first radius; wherein the amount of material removed from a work-surface by the surface-treating article is a function of the difference between the first concentration and the second concentration.

Embodiment 30 provides he surface-treating article of embodiment 29, wherein the pattern of material removed from the work-surface by the surface-treating article is a function of the difference between the first concentration and the second concentration.

Embodiment 31 provides the surface-treating article of embodiments 29-30, wherein the work-surface comprises wood, stone, metal, ceramic, glass, mineral, cured polymer, or combinations thereof.

What is claimed is:

1. A surface-treating article, comprising:

a circular substrate comprising a web of open, lofty, nonwoven fibers, the substrate comprising a first major surface; and a coating including an abrasive and a resin disposed on the first major surface;

wherein the abrasive having a first concentration at a first radius measured from the center of the substrate, wherein the abrasive having a second concentration not equal to the first concentration at a second radius measured from the center of the substrate, wherein the first radius and the second radius are different lengths and the length of the first radius is less than the length of the second radius, wherein the first concentration and the second concentration are greater than zero, wherein the abrasive has a third concentration at a third radius measured from the center of the substrate, and wherein the first and third concentration are both greater than the second concentration, and the length of the second radius is between the length of the first radius and the third radius.

2. The surface-treating article of claim 1, wherein the substrate comprises natural fiber, a polyamide, a polyester, rayon, polyethylene, polypropylene, a synthetic fiber, or a combination thereof.

3. The surface-treating article of claim 1, wherein the abrasive comprises abrasive grains.

4. The surface-treating article of claim 1, wherein the substrate further comprises a second major surface.

5. The surface-treating article of claim 4, further comprising an abrasive coating disposed on the second major surface having a greater hardness than the substrate.

6. The surface-treating article of claim 1, wherein the first concentration is greater than the second concentration.

7. The surface-treating article of claim 1, wherein the second concertation is greater than the first concentration.

8. The surface-treating article of claim 1, wherein the coating is disposed on the first major surface in a radially non-uniform gradient.

9. The surface-treating article of claim 1, wherein a concentration of the abrasive at the first radius to the second radius decreases from the first concentration in a gradient distribution to the second concentration.

10. The surface-treating article of claim 1, wherein a concentration of the abrasive at the first radius to the second radius increases from the first concentration in a gradient distribution to the second concentration.

11. The surface-treating article of claim 1, wherein the first concentration or the second concentration is a maximum abrasive concentration of the first major surface of the surface-treating article.

12. The surface-treating article of claim 1, wherein the first concentration or the second concentration is a minimum abrasive concentration of the first major surface of the surface-treating article.

13. The surface-treating article of claim 1, wherein the first major surface comprises a central region substantially free of intentionally included abrasive.

14. A surface-treating article, comprising:

a circular substrate comprising natural fiber, a polyamide, a polyester, rayon, polyethylene, polypropylene, or a combination thereof and having a first major surface;

a coating including a single abrasive formulation disposed on the first major surface in a radially non-uniform gradient;

the single abrasive formulation having a first concentration at a first radius, the single abrasive formulation having a second concentration at a second radius that is a different length than the first radius, wherein a ratio of the first concentration to the second concentration ranges from about 2:1 to about 1.1:1, and wherein the length of the first radius is less than the length of the second radius, wherein the abrasive has a third concentration at a third radius measured from the center for the substrate, and wherein the first and third concentrations are both greater than the second concentration, and the length of the second radius is between the length of the first radius and the third radius.

15. A surface-treating article, comprising:

a circular substrate comprising natural fiber, a polyamide, a polyester, rayon, polyethylene, polypropylene, or a combination thereof and having a first major surface;

a coating including a single abrasive formulation disposed on the first major surface in a radially non-uniform gradient;

the single abrasive formulation having a first concentration at a first radius measured from the center of the substrate;

the single abrasive formulation having a second concentration at a second radius measured from the center of the substrate that is a different length than the first radius, wherein a ratio of the first concentration to the second concentration is 1:1.2 to about 1:2.2; and wherein the length of the first radius is less than the length of the second radius, wherein the abrasive has a third concentration at a third radius measured from the center of the substrate, and wherein the first and third concentrations are both greater than the second concentrations, and the length of the second radius is between the length of the first radius and the third radius.

* * * * *